United States Patent [19]

Nobileau

[11] Patent Number: 4,951,988

[45] Date of Patent: Aug. 28, 1990

[54] CASING HANGER PACKOFF RETRIEVING TOOL

[75] Inventor: Philippe C. Nobileau, Paris, France

[73] Assignee: Vetco Gray Inc., Houston, Tex.

[21] Appl. No.: 285,218

[22] Filed: Dec. 16, 1988

[51] Int. Cl.[5] ..... E21B 31/12

[52] U.S. Cl. ..... 294/86.15; 294/86.25; 166/120

[58] Field of Search ..... 294/86.15, 86.14, 86.24, 294/86.25 X; 166/98, 101, 120 X, 121, 122

[56] References Cited

U.S. PATENT DOCUMENTS

| | | | |
|---|---|---|---|
| 1,917,135 | 7/1933 | Littell | 294/86.25 X |
| 2,829,716 | 4/1958 | Stewart . | |
| 3,011,557 | 12/1961 | Conrad | 166/120 X |
| 3,265,431 | 8/1966 | Burner | 294/86.25 |
| 3,944,273 | 3/1976 | Ahlstone . | |
| 4,273,372 | 6/1981 | Sheshtawy | 294/86.15 |

*Primary Examiner*—Margaret A. Focarino

*Assistant Examiner*—Dean J. Kramer

*Attorney, Agent, or Firm*—James E. Bradley

[57] ABSTRACT

The retrieving tool for retrieving a packoff from a casing hanger located in a subsea well has a pressure intensifying assembly. The retrieving tool has a mandrel which is connected to a string of conduit lowered from a floating vessel. A body is carried by the mandrel for landing on the casing hanger. A mandrel piston is located on the mandrel for movement with the mandrel and sealingly engages the bore of the body. This results in a pressure chamber above the mandrel piston, which is filled with a hydraulic fluid. A retrieving piston has a retrieving sleeve that latches into the packoff. The retrieving piston is carried above the mandrel piston in fluid communication with the pressure chamber. The pressure areas of the retrieving piston and the mandrel piston are dimensioned so that an increase of pressure due to movement of the mandrel piston will cause a greater force to be exerted by the retrieving piston.

3 Claims, 2 Drawing Sheets

CASING HANGER PACKOFF RETRIEVING TOOL

BACKGROUND OF THE INVENTION

1. Field of the Invention:

This invention relates in general to retrieving tools for retrieving a packoff from a casing hanger landed in a subsea well, particularly a metal seal packoff.

2. Description of the Prior Art:

In the subsea wells of the type concerned herein, a wellhead will be located at the subsea floor. One or more strings of casing are supported at the wellhead, each by a casing hanger. A packoff seals the annular space surrounding each casing hanger.

Occasionally, a packoff may need to be retrieved to the surface. A floating vessel located at the surface will connect to the wellhead by means of a riser. A retrieving tool is lowered on a drill string. The retrieving tool has a means for securing to the packoff. Then the drill string is pulled upward to release the packoff.

While this is satisfactory for elastomeric seal packoffs, it is more difficult to achieve with a metal packoff. Elastomeric packoffs are set at much lower forces than metal packoffs. It may be difficult to achieve sufficient pulling force with the drill string to pull a metal packoff loose.

SUMMARY OF THE INVENTION

The running tool of this invention utilizes a mandrel which connects to the drill string for movement therewith. The mandrel has a mandrel piston that moves with the mandrel. The mandrel piston slides against a running tool body that lands on the casing hanger.

A retrieving sleeve piston is also carried by the mandrel. The retrieving sleeve piston has a depending sleeve with a latch for latching to the packoff. The sleeve has an inner wall that slidingly engages the outer wall of the running tool body.

A pressure chamber is located between the mandrel piston, the body, and the retrieving sleeve piston. This pressure chamber is sealed from the exterior and filled with a hydraulic fluid. Upward movement of the mandrel piston due to pulling upward on the drill string increases the pressure in this pressure chamber. The increase in pressure is applied to the retrieving sleeve piston, to force the retrieving sleeve and the packoff upward. The retrieving sleeve piston has a much larger pressure area than the pressure area of the mandrel piston. Consequently, the upward force is intensified. The pull on the packoff will be much greater than the actual pull on the drill string.

DESCRIPTION OF THE PREFERRED EMBODIMENT

Figure 1:
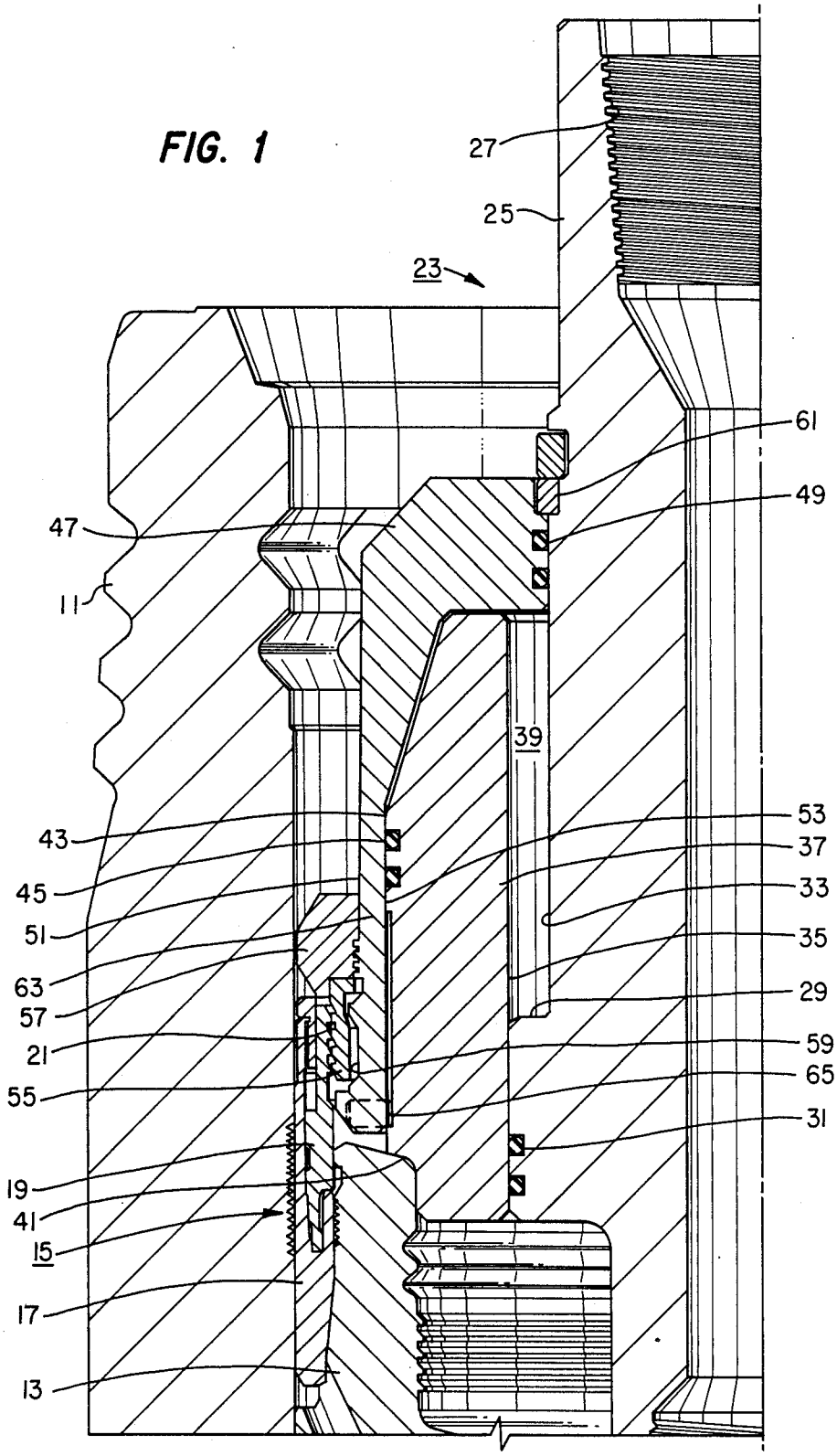
FIG. 1 is a quarter cross-sectional view illustrating a running tool constructed in accordance with this invention, and shown with the mandrel in a lower position.

Referring to FIG. 1, wellhead 11 will be located on the subsea floor. A riser (not shown) will extend from a floating vessel down to the wellhead. A casing hanger 13 is landed in the wellhead 11. Casing hanger 13 will be connected to a string of casing (not shown) extending into the well. A packoff 15 locates in an annular space between the casing hanger 13 and the bore of the wellhead 11 to seal the annulus surrounding the casing.

In the embodiment shown, packoff 15 has a metal seal 17. A wedge ring 19 locates within an annular central cavity in the seal 17. A running tool (not shown) moves the wedge ring 19 downward to set the packoff 15, forcing the inner and outer walls of seal 17 farther apart to form a metal seal. The wedge ring 19 remains with the packoff 15 after the packoff 15 is set. It has threads or grooves 21 on its upper end on the inner wall to be used in retrieving the packoff 15 at a later date.

A retrieving tool 23 is used to retrieve the packoff 15 after it has been set. Retrieving tool 23 has a central, axial mandrel 25. Mandrel 25 has threads 27 on its upper end, which serve as connection means for connecting the mandrel 25 to the lower end of the string of conduit, such as a string of drill pipe (not shown).

A mandrel piston 29 is integrally formed on the mandrel 25. Mandrel piston 29 extends radially outward from the mandrel 25 and has seals 31 on its outer diameter. An exterior cylindrical wall 33 of smaller diameter than mandrel piston 29 is formed on the mandrel 25 above the mandrel piston 29.

The mandrel piston 29 slidingly and sealingly engages a bore 35 of a body 37. A pressure chamber 39 is defined by the space between the bore 35 of body 37 and the exterior wall 33 of mandrel 25. The pressure area of mandrel piston 29 is the transverse cross-sectional area of the mandrel piston 29. This pressure area corresponds to the difference between the diameter of the bore 35 and the outer diameter of the exterior wall 33.

Body 37 has a landing shoulder 41 on its lower end that serves as means for landing the retrieving tool 23 on the upper end of the casing hanger 13. Body 37 is tubular, having an exterior wall 43 that is cylindrical. Seals 45 are located on the exterior wall 43.

A retrieving sleeve piston 47 is carried by mandrel 25. The retrieving sleeve piston 47 is an annular member for carrying packoff 15. Retrieving sleeve piston 47 has an inner diameter containing seals 49 which sealingly engage the exterior wall 33 of mandrel 25. A retrieving sleeve 51 is integrally formed with and depends downward from the retrieving sleeve piston 47. The retrieving sleeve 51 has an inner cylindrical wall 53. The inner wall 53 sealingly and slidingly engages the exterior wall 43 of the body 37.

A latch means for latching into the packoff 15 is carried on the outer wall of the retrieving sleeve 51. This latch means comprises a split latch ring 55. The latch ring 55 is retained on its upper end by a collar 57 and is located in a recess 59 on the retrieving sleeve 51. The latch ring 55 has grooves on its exterior adapted to latch into and engage the grooves 21 on the packoff wedge ring 19. Once engaged, the retrieving sleeve 51 will be locked to the packoff wedge ring 19, so that upward movement of the retrieving sleeve 51 will cause upward movement of the wedge ring 19.

The retrieving sleeve piston 47 serves as reacting means in fluid communication with the pressure chamber 39 for upward movement relative to the body 37 in response to a pressure increase in the pressure chamber 39. The retrieving sleeve piston 47 has a pressure area that is greater than the pressure area of the mandrel piston 29. The pressure area of the retrieving sleeve piston 47 is the transverse cross-sectional area that is bounded on the inner side by the mandrel exterior wall 33 and on the outer side by the body exterior wall 43.

The chamber 39 is filled with a substantially incompressible hydraulic fluid and is sealed from the exterior of the retrieving tool 23 by means of the seals 31, 45, and 49.

A pair of stop rings 61 located on the mandrel 25 serve as a stop to limit downward movement of the mandrel 25 relative to the retrieving sleeve piston 47 and body 37. The body 37 is retained with the retrieving tool 23 by means of a downward facing retention shoulder 63 formed on the exterior wall 43 of the body 37. The retention shoulder 63 is adapted to engage a plurality of pins 65 (only one shown) located on the lower end of the retrieving sleeve 51.

In operation, to retrieve packoff 15, the retrieving tool 23 is lowered on a string of conduit, such as drill pipe. Initially, the retrieving sleeve piston 47 will be located in contact with the upper side of the mandrel piston 29. The body 37 will be located in a lower position (not shown) with the retention shoulder 63 in contact with the retention pins 65. The body 37 will first land on the upper end of the casing hanger 13. Continued downward movement of mandrel 25 results in the stop rings 61 contacting the upper end of retrieving sleeve piston 47. The weight of the drill string pushes down on the retrieving sleeve piston 47, causing the latch ring 55 to ratchet into engagement with the grooves 21 of the packoff 15.

Then, the drill string is pulled upward. The mandrel piston 29 will cause a pressure increase in the hydraulic fluid. The pressure of the hydraulic fluid in the chamber 39 acts against the retrieving sleeve piston 47. The piston 47 will start to move upward, pulling the wedge ring 19 upward from the seal 17.

The pressure in the pressure chamber 39 is equal to the upward force on the mandrel 25 divided by the pressure area of the mandrel piston 29. The force exerted on the packoff assembly 15 is equal to the pressure in the pressure chamber 39 times the pressure area of the retrieving sleeve piston 47. For example, if the pressure area of the retrieving sleeve 47 is ten times that of the pressure area of the mandrel piston 29, then the upward force exerted by the retrieving sleeve 51 will be ten times that of the upward force pulled on the drill string. The intensification of the force provides a sufficient force for retrieving a metal seal packoff 15.

Figure 2:
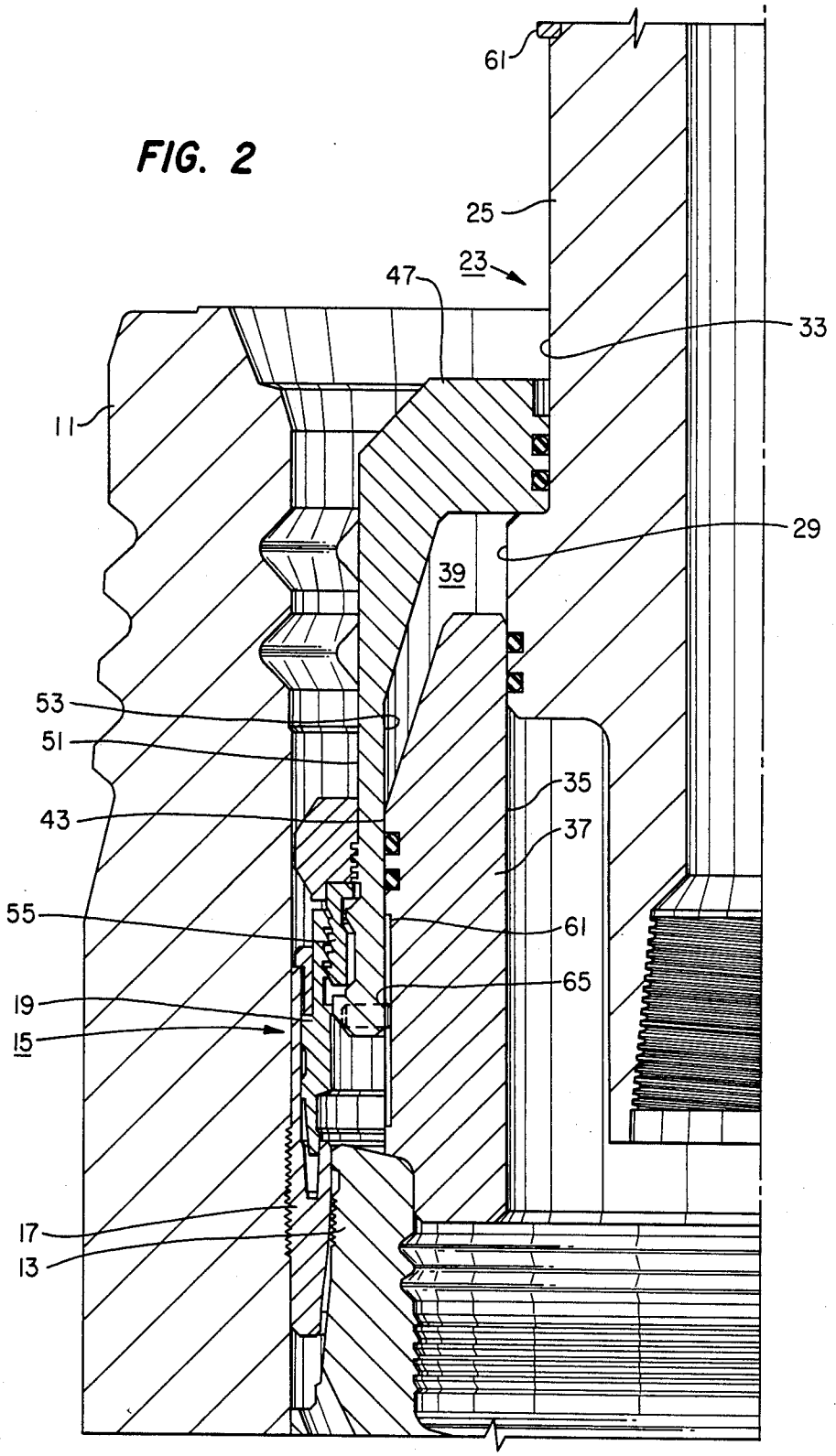
FIG. 2 is a quarter cross-sectional view of the running tool of FIG. 1, and showing the mandrel lifted into an upper position for releasing the packoff.

When in the uppermost position, the retrieving tool 23 appears as shown in FIG. 2. Continued upward pulling will retrieve the entire packoff assembly 15. A new packoff can then be lowered in place and set using a running tool (not shown).

The invention has significant advantages. The running tool is able to retrieve a metal seal packoff by intensifying the actual force pulled on the drill string.

While the invention has been shown in only one of its forms, it should be apparent to those skilled in the art that it is not so limited, but is susceptible to various changes without departing from the scope of the invention.

I claim:

1. A retrieving tool for retrieving a packoff from a casing hanger, comprising:

a mandrel having means on an upper end for connection to a string of conduit;

a body carried by the mandrel having means for landing on the casing hanger, the body having a bore and an exterior wall;

a mandrel piston located on the mandrel for movement therewith, the mandrel piston having a pressure area and sealingly engaging the bore of the body, defining a pressure chamber above the mandrel piston between the mandrel and the bore of the body;

a retrieving sleeve piston carried for movement relative to the mandrel and to the body, the retrieving sleeve piston having a depending sleeve portion that has an inner wall that sealingly and slidingly engages the exterior wall of the body, the retrieving sleeve piston having a lower side in communication with the pressure chamber, the retrieving sleeve piston having a greater pressure area than the pressure area of the mandrel piston;

latching means on the exterior of the sleeve portion for latching to the packoff; and the pressure chamber being filled with a hydraulic fluid and sealed from the exterior of the retrieving tool, so that upward movement of the mandrel by pulling upward on the conduit causes the mandrel piston to increase pressure in the pressure chamber to cause the retrieving sleeve piston to move upward relative to the body to pull the packoff upward.

2. A retrieving tool for retrieving a packoff from a casing hanger, comprising:

a mandrel having means on an upper end for connection to a string of conduit;

a body carried by the mandrel having a lower end for landing on the casing hanger, the body having a bore and an exterior wall;

a mandrel piston extending radially outward from a cylindrical exterior wall of the mandrel and having an outer diameter sealingly engaging the bore of the body, the mandrel piston having a pressure area defined by the difference in diameter between the exterior wall of the mandrel and the bore of the body;

an annular retrieving sleeve piston having an inner diameter that sealingly and slidingly engages the exterior wall of the mandrel above the mandrel piston, the retrieving sleeve piston having a depending sleeve portion that has an inner wall that sealingly and slidingly engages the exterior wall of the body, the retrieving sleeve piston having a pressure area that is greater than the pressure area of the mandrel piston and which is defined by the difference in diameter between the exterior wall of the mandrel and the exterior wall of the body;

latching means on the exterior of the sleeve portion for latching to the packoff; and the space between the mandrel piston and retrieving sleeve piston being sealed from the exterior of the retrieving tool and filled with a hydraulic fluid, so that upward movement of the mandrel by pulling upward on the conduit causes the mandrel piston to increase pressure of the hydraulic fluid to cause the retrieving sleeve piston to move upward relative to the body to pull the packoff upward.

3. A method for retrieving a packoff from a casing hanger, comprising:

connecting a mandrel to a string of conduit;

mounting a body to the mandrel for axial movement relative to each other;

providing a mandrel piston with a pressure area on the mandrel for movement therewith, which defines a pressure chamber between the mandrel and the body, and filling the pressure chamber with a hydraulic fluid;

mounting a retrieving sleeve to the mandrel with a pressure area in fluid communication with the pressure chamber;

lowering the mandrel on the conduit, landing the body on the casing hanger and latching the retrieving sleeve to the packoff; and lifting the conduit and mandrel, causing the mandrel piston to move upward to increase pressure in the pressure chamber, thereby moving the retrieving sleeve upward relative to the body to pull the packoff upward, the pressure area of the retrieving sleeve being greater than the pressure area of the mandrel piston so that the lifting force applied by the retrieving sleeve to the packoff is greater than the lifting force on the conduit.

* * * * *